US007796143B2

(12) United States Patent
Huang

(10) Patent No.: US 7,796,143 B2
(45) Date of Patent: Sep. 14, 2010

(54) METHOD AND STRUCTURE FOR AUTOMATIC ADJUSTING BRIGHTNESS AND DISPLAY APPARATUS

(75) Inventor: Jih-Fon Huang, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 1208 days.

(21) Appl. No.: 11/307,427

(22) Filed: Feb. 7, 2006

(65) Prior Publication Data

US 2007/0115302 A1 May 24, 2007

(30) Foreign Application Priority Data

Nov. 24, 2005 (TW) ..... 94141252 A

(51) Int. Cl.
*G09G 5/10* (2006.01)

(52) U.S. Cl. ..... 345/690; 345/102

(58) Field of Classification Search ..... 345/102, 345/204, 691, 690

See application file for complete search history.

(56) References Cited

U.S. PATENT DOCUMENTS 5,381,074 A * 1/1995 Rudzewicz et al. ..... 315/77
6,674,429 B1 * 1/2004 Correa et al. ..... 345/211
6,777,710 B1 8/2004 Koyama ..... 257/59
7,339,565 B2 * 3/2008 Kim ..... 345/88
2002/0154088 A1 10/2002 Nishimura ..... 345/102
2005/0057486 A1 3/2005 Aoki et al. ..... 345/102
2006/0152452 A1 * 7/2006 Hoppenbrouwers et al. ... 345/77

FOREIGN PATENT DOCUMENTS

TW 200532609 10/2005

* cited by examiner

*Primary Examiner*—Amare Mengistu
*Assistant Examiner*—Steven E Holton
(74) *Attorney, Agent, or Firm*—Jianq Chyun IP Office

(57) ABSTRACT

A method for automatic adjusting brightness includes receiving pixel information. The pixel information are analyzed to obtain an image load. The image load is compared with a predetermined range. If the image load is less than the range, then a display duty cycle is set to be an upper limit. If the image load is greater than the range, then the display duty cycle is set to be a lower limit. If the image load is in the range, then the display duty cycle is set to an operation quantity between the upper limit and the lower limit, according to a current image load. Further, according to the changing of display duty cycle, two ranges are set to have the hysteresis effect.

23 Claims, 9 Drawing Sheets

METHOD AND STRUCTURE FOR AUTOMATIC ADJUSTING BRIGHTNESS AND DISPLAY APPARATUS

CROSS-REFERENCE TO RELATED APPLICATION

This application claims the priority benefit of Taiwan application serial no. 94141252, filed on Nov. 24, 2005. All disclosure of the Taiwan application is incorporated herein by reference.

BACKGROUND OF THE INVENTION

1. Field of Invention

The present invention relates to a technology of controlling light source of display apparatus. More particularly, the present invention relates to a technology of controlling light source of display apparatus, which has a feature of automatic adjusting brightness.

2. Description of Related Art

In daily life, image display apparatus is an important tool to display video information. In particular, there is static or dynamic image information in most of the current multimedia information. For example, the display of TV needs the display apparatus to display the video. The image information needs the image display apparatus to display the contents of information. Along with the improvement of science and technology, the display apparatus has been developed into a pixel array structure comprising a plurality of pixels to display image. The current prevalent display apparatus includes, for example, liquid crystal display (LCD), plasma display panel (PDP), organic light-emitting diode (OLED) display panel, etc.

A display apparatus generally requires a light source to display images, and the brightness of the image is related to the driving power. A conventional display apparatus sets a fixed relationship between the driving power and the brightness, which will not be adjusted along with the status of image to be displayed. In this way, if the image to be displayed is mostly composed of bright pixels or dark pixels, human eyes may have different responses for the display effect. For example, as shown in FIG. 1, when displaying the sparkling stars 102 in a night sky 100, if the driving power is reduced because of the little white area, the display effect of the stars will be not good. Again, as shown in FIG. 2, if keeping the same driving power for the image comprising a big part of white area 104 and a small part of black area 106, the structure scale level of the white area 104 appears monotonous.

Therefore, manufacturers in the art still continue to research to search for better driving mode with function of automatic adjusting the brightness of the image.

SUMMARY OF THE INVENTION

Accordingly, the present invention is directed to providing a method for automatic adjusting brightness, suitable for use in a display apparatus to control the display duty circle of pixel so as to control the brightness of the pixel.

The present invention also provides a structure for automatic adjusting brightness, suitable for controlling the display duty circle of pixel so as to control the brightness of the pixel.

The present invention provides a display apparatus, comprising the above structure for automatic adjusting brightness to control the display duty circle of pixel so as to control the brightness of the pixel.

The present invention provides a method for automatic adjusting brightness, suitable for use in a display apparatus to control a display duty cycle. The display duty cycle is a ratio corresponding to a display cycle of a pixel. The method for automatic adjusting brightness includes receiving pixel information of an image, wherein the image has a total quantity of pixels. The pixel information is analyzed to obtain an image load. The image load is compared with a first predetermined range, wherein the first comparison condition includes as follows. If the image load is less than the first predefined range, then a display duty cycle is set to be an upper limit. If the image load is greater than the first predefined range, then the display duty cycle is set to be a lower limit. If the image load is in the first predefined range, then the display duty cycle is set to a first operation quantity between the upper limit and the lower limit, according to a current image load.

According to one embodiment of the present invention, the above mentioned method for automatic adjusting brightness further includes providing a second predefined range which forms a second comparison condition. Wherein, if the current display duty cycle is less than the previous display duty cycle, the first comparison condition is selected; if the current display duty cycle is greater than the previous display duty cycle, the second comparison condition is selected.

According to the above mentioned method for automatic adjusting brightness in one embodiment of the present invention, wherein the second comparison condition includes: if the image load is less than the second predefined range, then the display duty cycle is set to be an upper limit. If the image load is greater than the second predefined range, then the display duty cycle is set to be a lower limit. If the image load is in the second predefined range, then the display duty cycle is set to a second operation quantity between the upper limit and the lower limit, according to the current image load.

According to the above mentioned method for automatic adjusting brightness in one embodiment of the present invention, wherein, comparing with the first predefined range, the second predefined range adds a hysteresis corresponding to the image load so as to form a path for hysteresis adjusting.

The present invention also provides a structure for automatic adjusting brightness, suitable for receiving pixel information to control a display duty cycle of a display apparatus. The display duty cycle is a ratio corresponding to a display cycle of pixel. The structure for automatic adjusting brightness includes a pixel information detecting unit receiving the pixel information and converting the pixel information to multiple digitalized pixel information; and a processing unit, coupled with the pixel information detecting unit to process the digitalized pixel information. Wherein, the processing unit analyzes and obtains an image load according to the digitalized pixel information of an image, and compares the image load with a first predetermined range, so as to output a first control signal to control the display duty cycle of the display apparatus.

According to the above mentioned structure for automatic adjusting brightness in one embodiment of the present invention, wherein the first comparison condition for comparing the image load with a first predetermined range includes as follows. If the image load is less than the first predefined range, then a display duty cycle is set to be an upper limit. If the image load is greater than the first predefined range, then the display duty cycle is set to be a lower limit. If the image load is in the first predefined range, then the display duty cycle is set to an operation quantity between the upper limit and the lower limit, according to a current image load.

According to the above mentioned structure for automatic adjusting brightness in one embodiment of the present invention, wherein the processing unit further includes comparing the image load with a second predefined range to output a second control signal, so as to control the display duty cycle of the display apparatus. Comparing with the first predefined range, the second predefined range adds a hysteresis corresponding to the image load so as to form a hysteresis adjusting path.

According to the above mentioned structure for automatic adjusting brightness in one embodiment of the present invention, wherein, if the current display duty cycle is less than the previous display duty cycle, the first comparison condition is selected; if the current display duty cycle is greater than the previous display duty cycle, the second comparison condition is selected.

According to the above mentioned structure for automatic adjusting brightness in one embodiment of the present invention, wherein the second comparison condition includes as follows. If the image load is less than the second predefined range, then the display duty cycle is set to be an upper limit. If the image load is greater than the second predefined range, then the display duty cycle is set to be a lower limit. If the image load is in the second predefined range, then the display duty cycle is set to an operation quantity between the upper limit and the lower limit, according to a current image load.

In order to the make the aforementioned and other objects, features and advantages of the present invention comprehensible, a preferred embodiment accompanied with figures is described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
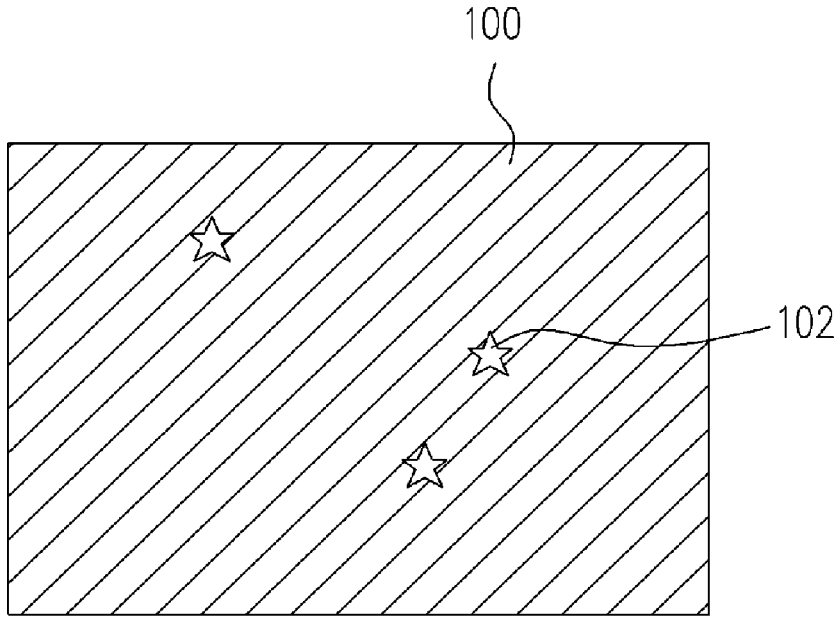
FIG. 1 (PRIOR ART)
FIG. 1 to FIG. 2 are diagrams showing the problems in conventional display technologies.
Figure 2:
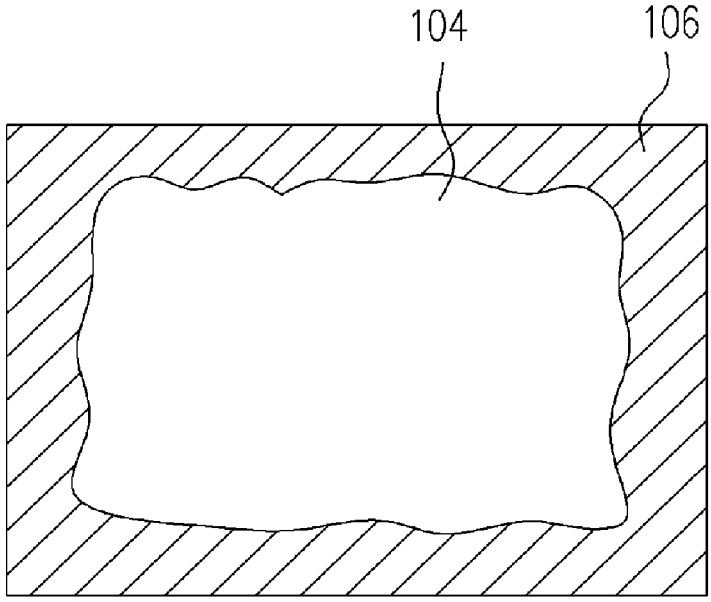
FIG. 2 (PRIOR ART)
Figure 3:
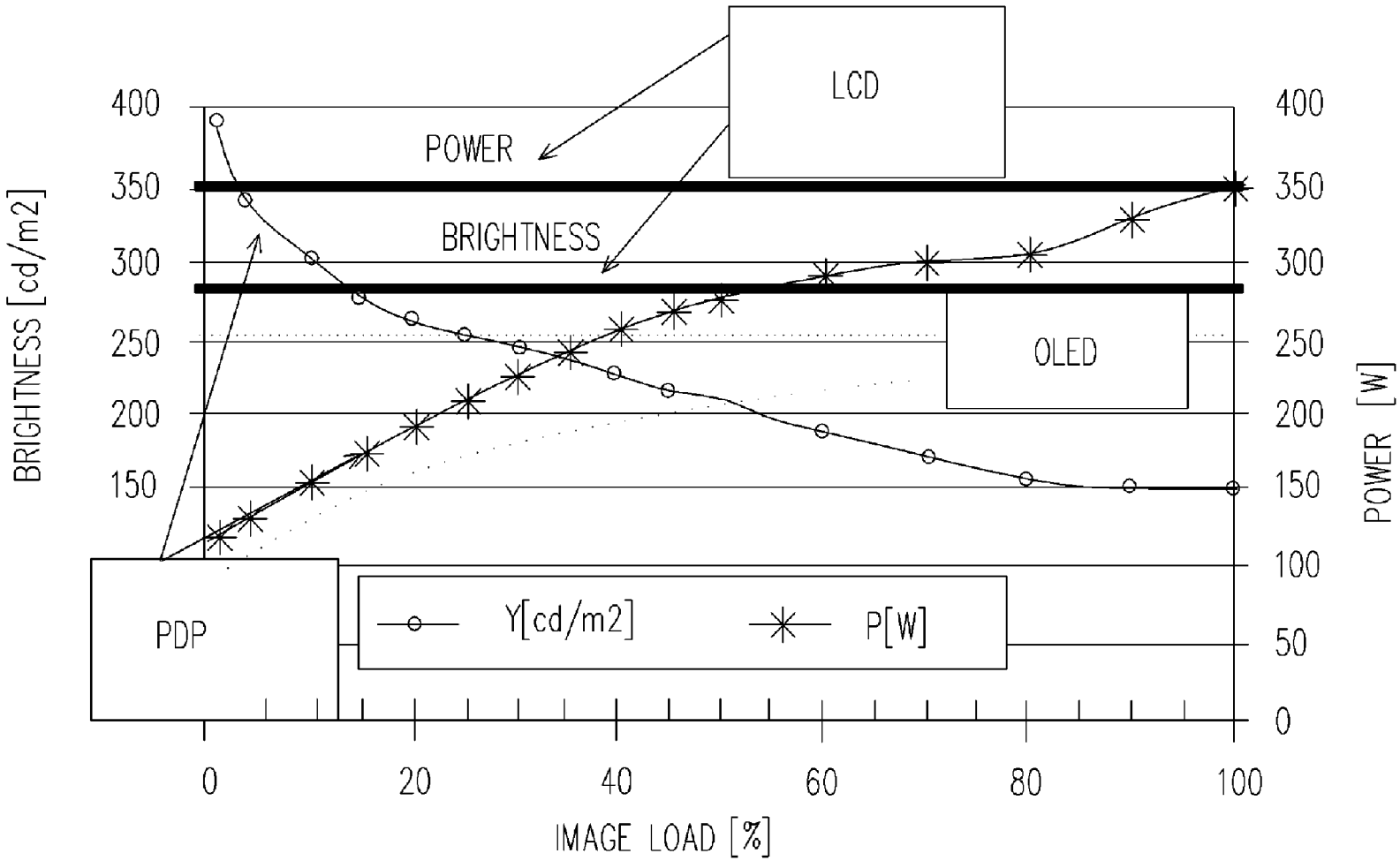
FIG. 3 is a diagram showing the changing trend of the driving power and the generated brightness along with the change of the image load.

For the display apparatus, according to the display mechanism, the changing trend of the driving power and the generated brightness along with the change of the image load is as shown in FIG. 3. The image load of an image is, for example, referred to the ratio of the quantity of the high brightness pixels to the total quantity of pixels in an image. The high brightness pixel refers to the pixel with the brightness greater than or equal to a brightness gray level. For example, the gray level of pixel has $2^8=256$ levels, and the high brightness pixel is referred to the pixel with brightness greater than or equal to $200^{th}$ level. However, the image load can be determined depending on the different mechanisms, but not depending on the above mode. For example, an average brightness can be added for consideration to determine the image load. In other words, the image load is a parameter used for denoting the image load status. Also, the curved line in FIG. 3 is just a schematic diagram, but not the absolute value. For the LCD, as the light source is provided by a backlight module, even the pixel is in OFF status, the backlight module will still continue to emit light. Also, for OLED, as the driving mechanism comprises a fixed power source, the thin dotted line representing the power source is also fixed. The brightness of the pixel depends on the current passing through the pixel, and the current is as shown as the thick dotted line.

Figure 4:
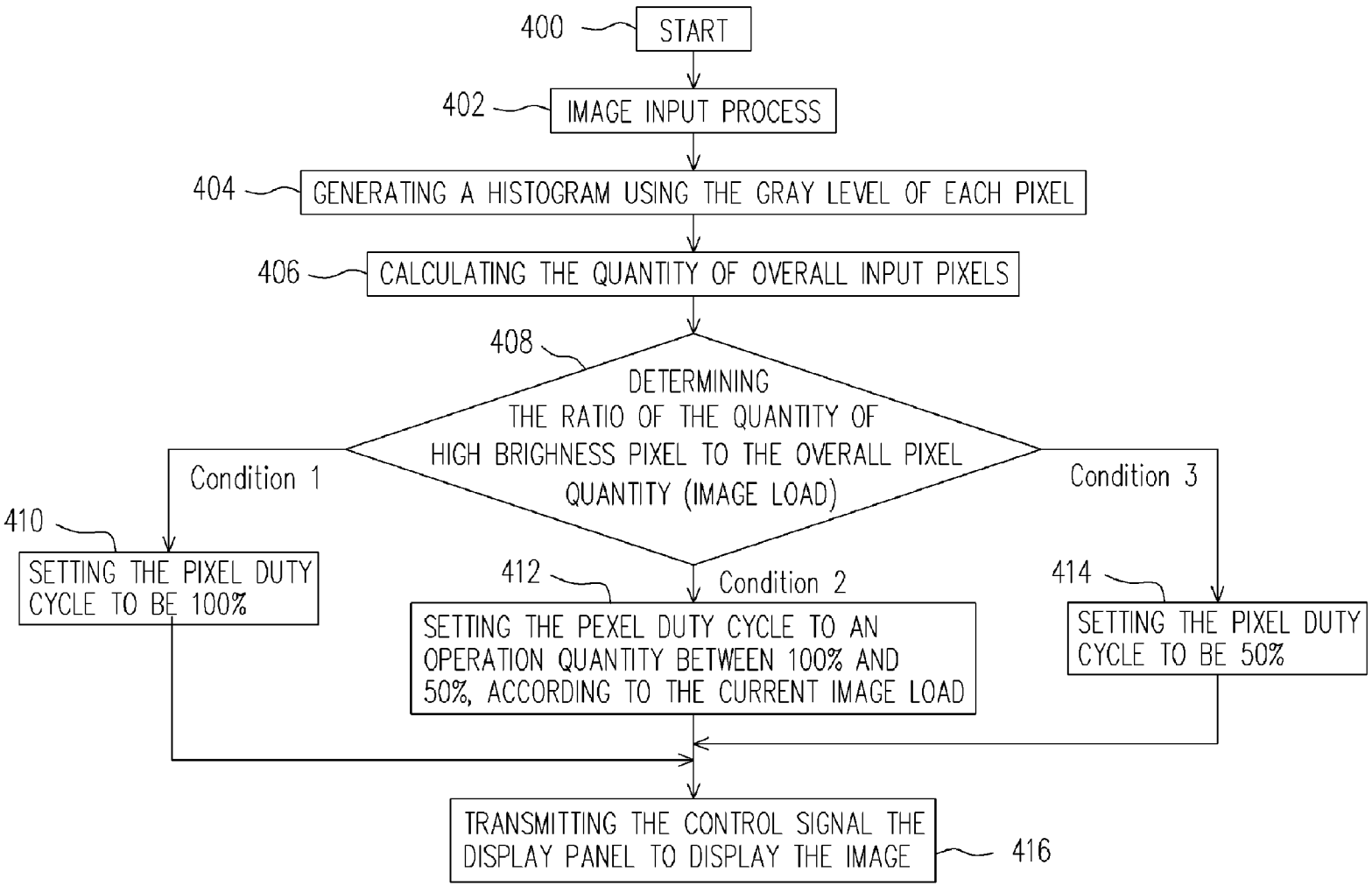
FIG. 4 is a schematic flow chart of a method for automatic adjusting brightness according to one embodiment of the present invention.
Figure 7:
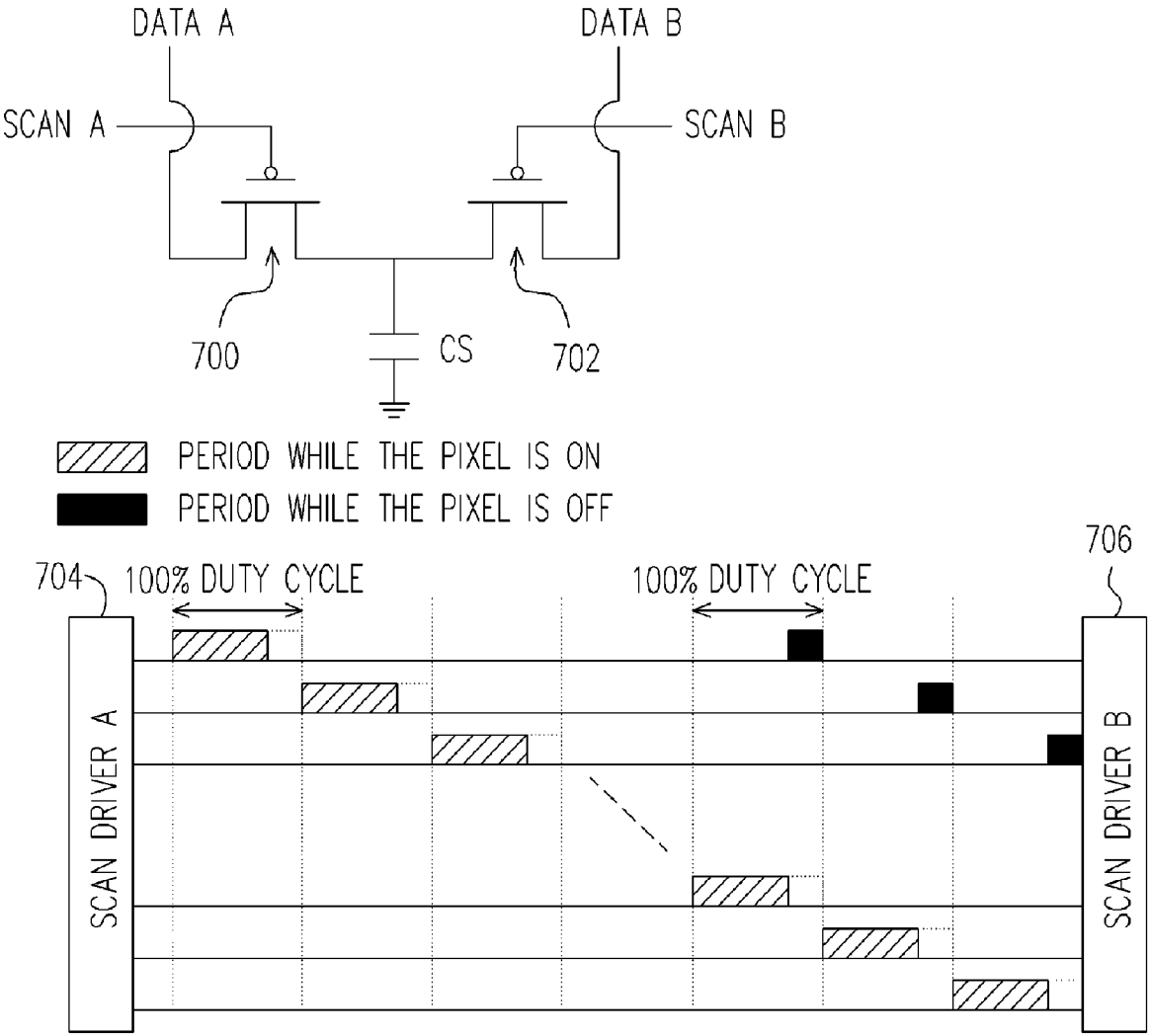
FIG. 7 is a schematic diagram of a circuit and mechanism controlling the display duty cycle according to the present invention.

Based on the relationship of the brightness and the image load, the present invention further proposes to control the brightness of the pixel by controlling the displaying duty cycle of the pixel. When displaying an image frame, a pixel has a full cycle of predefined ON. Accordingly, the display duty cycle refers to the period while the pixel is actually ON, and also refers to a ratio corresponding to the original predefined display cycle. FIG. 7 describes one of the methods of controlling the display duty cycle. The following will firstly describe one embodiment of the present invention. FIG. 4 is a schematic flow chart of a method for automatic adjusting brightness according to one embodiment of the present invention. Referring to FIG. 4, after a step 400 of starting, in step 402, the image input process is performed to convert the analog signals into digital signals so as to obtain the pixel information of an image. In step 404, a histogram of an image is made by using the gray level of each pixel, so as to obtain the pixel quantity distribution corresponding to the gray level. For example, the quantity of pixel with the gray level greater than a predefined grey level can be obtained according to the pixel quantity distribution in the histogram. It needs to be noticed that making the histogram is just an example, and one of the objectives is to obtain the quantity of high brightness pixels, therefore the histogram can be simplified to just count the quantity of pixels with brightness greater than a predefined brightness, or any other variations by which the quantity of high brightness pixels can be obtained. In step 406, the quantity of overall input pixels can also be obtained according to the histogram. As mentioned above, the step 404 and the step 406 can also be merged into single statistic process, or other equivalent, to obtain the two values of high brightness pixel quantity and the overall pixel quantity. Also, the overall pixel quantity can also be a predefined quantity according to the resolution of the display apparatus, and no need for additional statistic.

In step 408, the present invention may obtain the ratio of the quantity of high brightness pixel to the overall pixel quantity, i.e., the image load, according to the two numbers of high brightness pixels and the quantity of overall pixels. Please refer to FIG. 6 simultaneously in the following. According to the present invention, in order to automatically adjust the brightness, the image load may be divided into three areas, wherein there would set a comparison arrange, for example, 50%-80%. If the image load is less than 50%, i.e., condition 1, then the process goes to the step 410. If the image load is within the comparison range 50%-80%, i.e., condition 2, then the process goes to the step 412. If the image load is greater than 80%, i.e., condition 3, then the process goes to the step 414. The process would be different corresponding to the accordant conditions.

The step 410 is the process for condition 1, and the pixel duty cycle is set to be an upper limit, for example, 100%. That is, there is no change for the lasting period of the pixel in ON state, so as to keep the original brightness.

The step 412 is the process for condition 2, and the pixel duty cycle is set to an operation quantity between an upper limit (for example, 100%) and a lower limit (for example, 50%) according to the current image load. As the dotted line shown in FIG. 6, if the image load is 65%, the operation quantity of the display duty cycle is set to 75%. It needs to be noticed that there are many methods to set the operation quantity. That is, the display operation quantity may be an operation line, preferred to be a linear relation, between the image loads of 50%-80%. Therefore, within the range, the display operation quantity can also be preferred to be obtained using simple linear interpolation. If it is necessary, the operation line can also be smooth curved line or multiple linear sections or a function relation.

The step 414 is the process for condition 3, and the pixel duty cycle is set to be a lower limit, for example, 50%. That is, the lasting period of the pixel in ON status is one half of the original predefined lasting period, i.e., the brightness is reduced one half.

Next, a controlling signal is output to the display panel according to the display duty cycle determined by the step 410, the step 412, or the step 414. In step 416, the display panel will change the brightness to display the image according to the determined display duty cycle.

In general, according to the display capability of the display apparatus, the display duty cycle determined by the current input image will determine the brightness of the next image. However, if the hardware and operation speed of the display apparatus are allowable, the display duty cycle can be obtained in advance to change the brightness of the current image. The change is just a variation according to the actual design and does not deviate the scope of the specification of the present invention.

Figure 5:
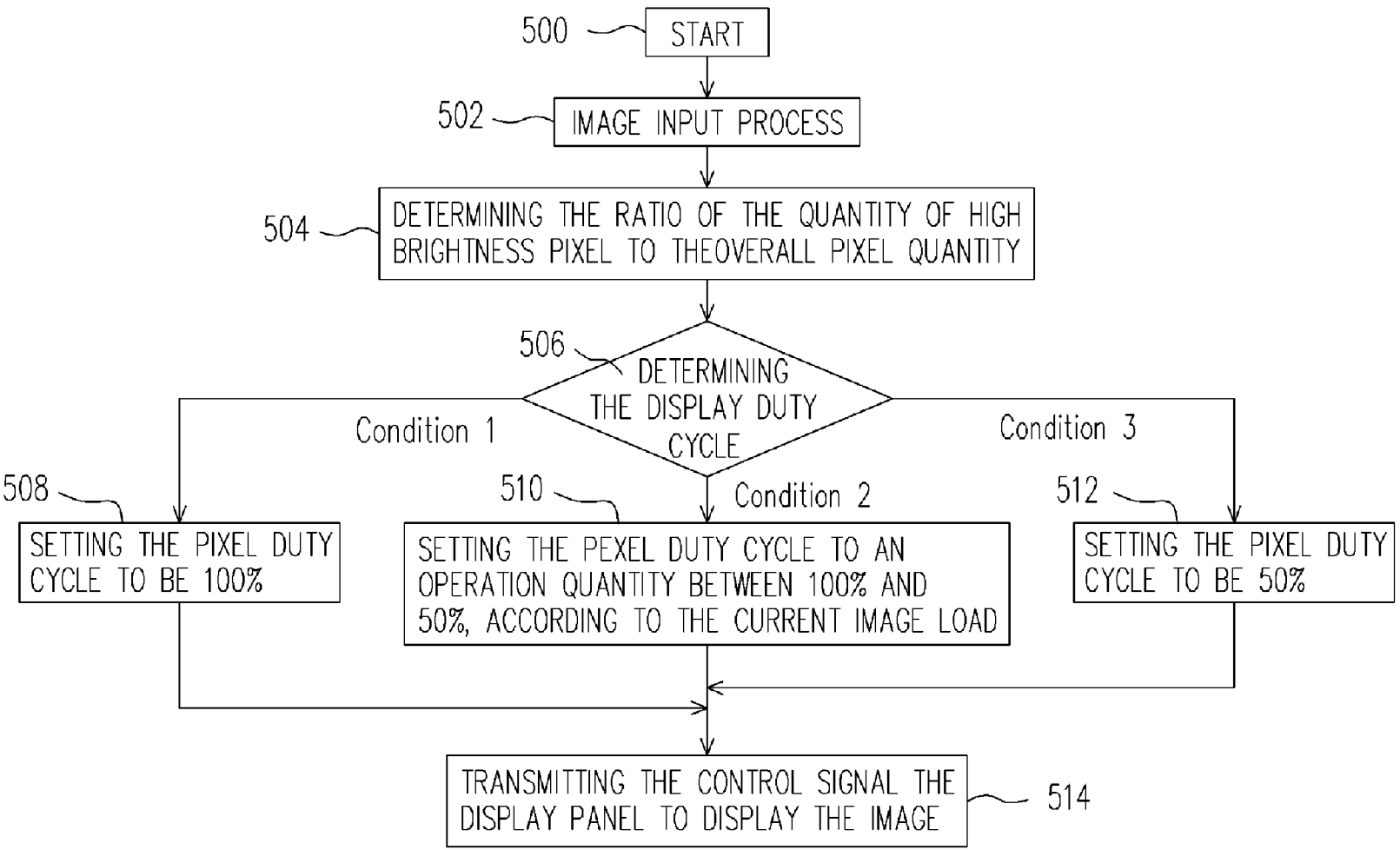
FIG. 5 is a schematic flow chart of a method for automatic adjusting brightness according to another embodiment of the present invention.

As mentioned above, the method in FIG. 4 is just an embodiment, wherein the display duty cycle needs to be determined, so that some steps can be simplified and merged. FIG. 5 is a schematic flow chart of a method for automatic adjusting brightness according to another embodiment of the present invention. In FIG. 5, after starting and image input processing in step 500 and step 502, in step 504, a ratio of the quantity of high brightness pixel in an image can be determined. In step 506, the display duty cycle can be determined by the condition 1, condition 2, or condition 3 selected according to the ratio. The subsequent steps 508, 510, 512, 514 are the same as the steps 410, 412, 414, 416 and their descriptions are omitted here. Also, the steps in FIG. 5 are just an embodiment of an actual process according to the specifications of the present invention. The steps can be suitably integrated and changed.

The following will continue to describe an embodiment of adjusting the display duty cycle. FIG. 7 is a schematic diagram of a circuit and mechanism controlling the display duty cycle according to the present invention. In FIG. 7, the upper diagram shows the driving circuit for single pixel. Those ordinarily skilled in the art know that the pixel is driven by a data line (data A) and a scan line (scan A). The scan line turns on the control transistor 700 according a sequence, and the data line inputs the display data. The normal display driving method can be performed using the data line (data A) and the scan line (scan A). Also, for each pixel, the same driving circuit is set at the same time, and the pixel is driven by a transistor 702 using another set of data line (data B) and scan line (scan B), and the objective is to input a black signal. The black signal represents the OFF status of the pixel. If there are synchronously changing operation quantities input to data B and scan B, the display duty cycle is changed. The transistor is, for example, thin-film transistor (TFT).

The lower diagram in FIG. 7 describes the controlling mechanism. According to the predefined sequence of the image frame, the scan driver A 704 activates the transistor 700 of the pixel in sequence. Wherein the time interval between the dotted lines is the originally predefined operation period, and the displaying duty cycle is 100%. If it is intended to change the display duty cycle, as shown in shaded area, it is just only a part of the whole operation period. In order to achieve the changing of the display duty cycle, for example, controlled by the scan driver B 706, a black signal representing that the pixel is switched to OFF status is input after a hysteresis period. Different types of display panels have different driving mechanisms. However, for example, the display duty cycle can be changed by adjusting the sequence of scanning. The above is just an embodiment of the present invention.

Figure 6:
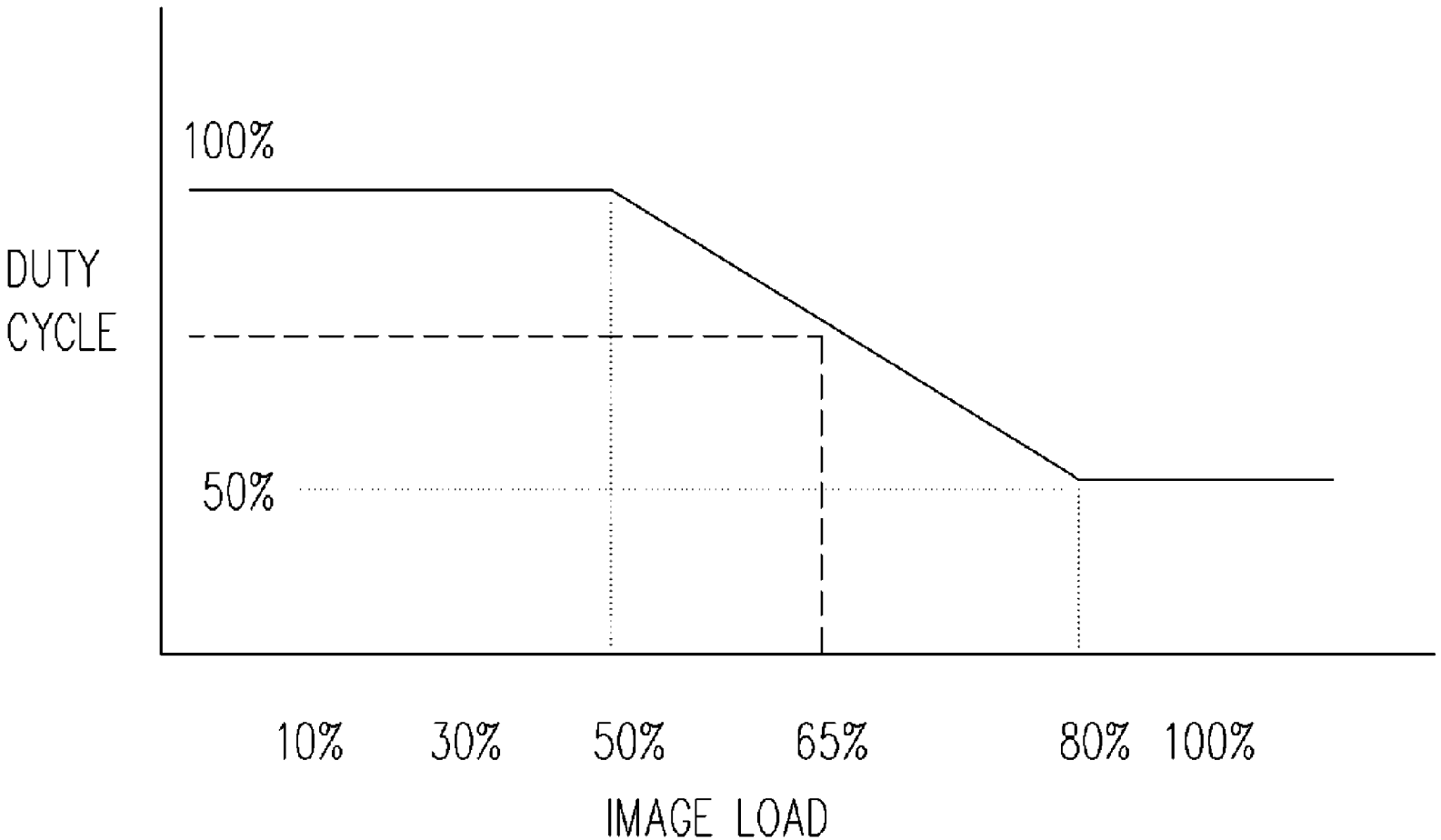
FIG. 6 is a structure for automatic adjusting brightness according to the present invention.
Figure 8:
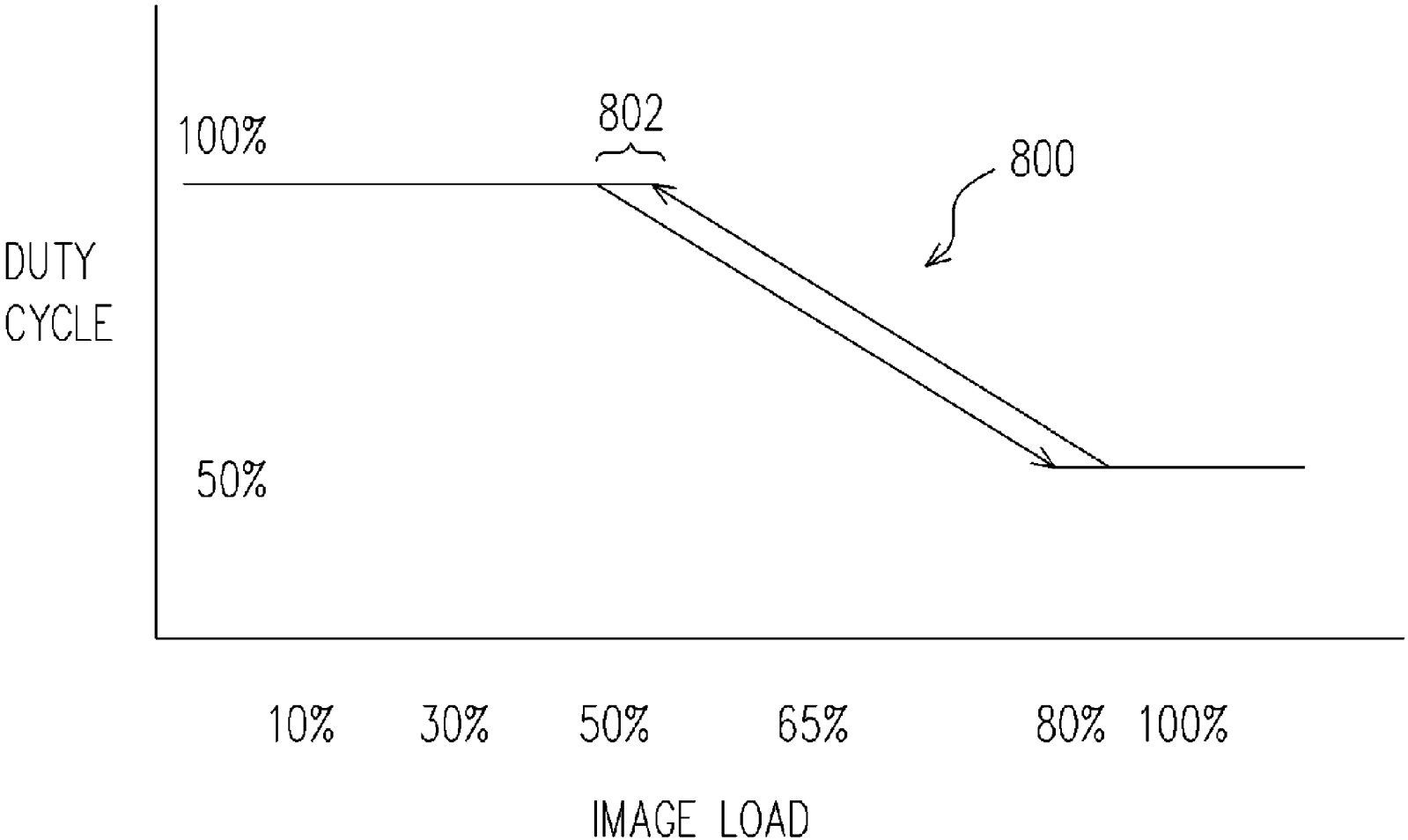
FIG. 8 is a diagram showing a mechanism with hysteresis effect for automatic adjusting brightness according to the present invention.

The following will discuss the further changing of the adjusting mechanism in FIG. 6. FIG. 8 is a diagram showing a mechanism with hysteresis effect for automatic adjusting brightness according to the present invention. When the display apparatus is displaying dynamic images, for example, when a sparking bright object is under displaying, the adjustment may be overdone. Therefore, the mechanism in FIG. 6 can also be added with the hysteresis effect so as to form a hysteresis path 800. When the current display duty cycle is less than the previous display duty cycle, the first comparison range 50%-80% related to the image load is selected for comparison. When the current display duty cycle is greater than the previous display duty cycle, the second comparison range 55%-85% related to the image load is selected for comparison. In other words, the hysteresis path 800 has a hysteresis 802, for example, 2%-5%.

Figure 9:
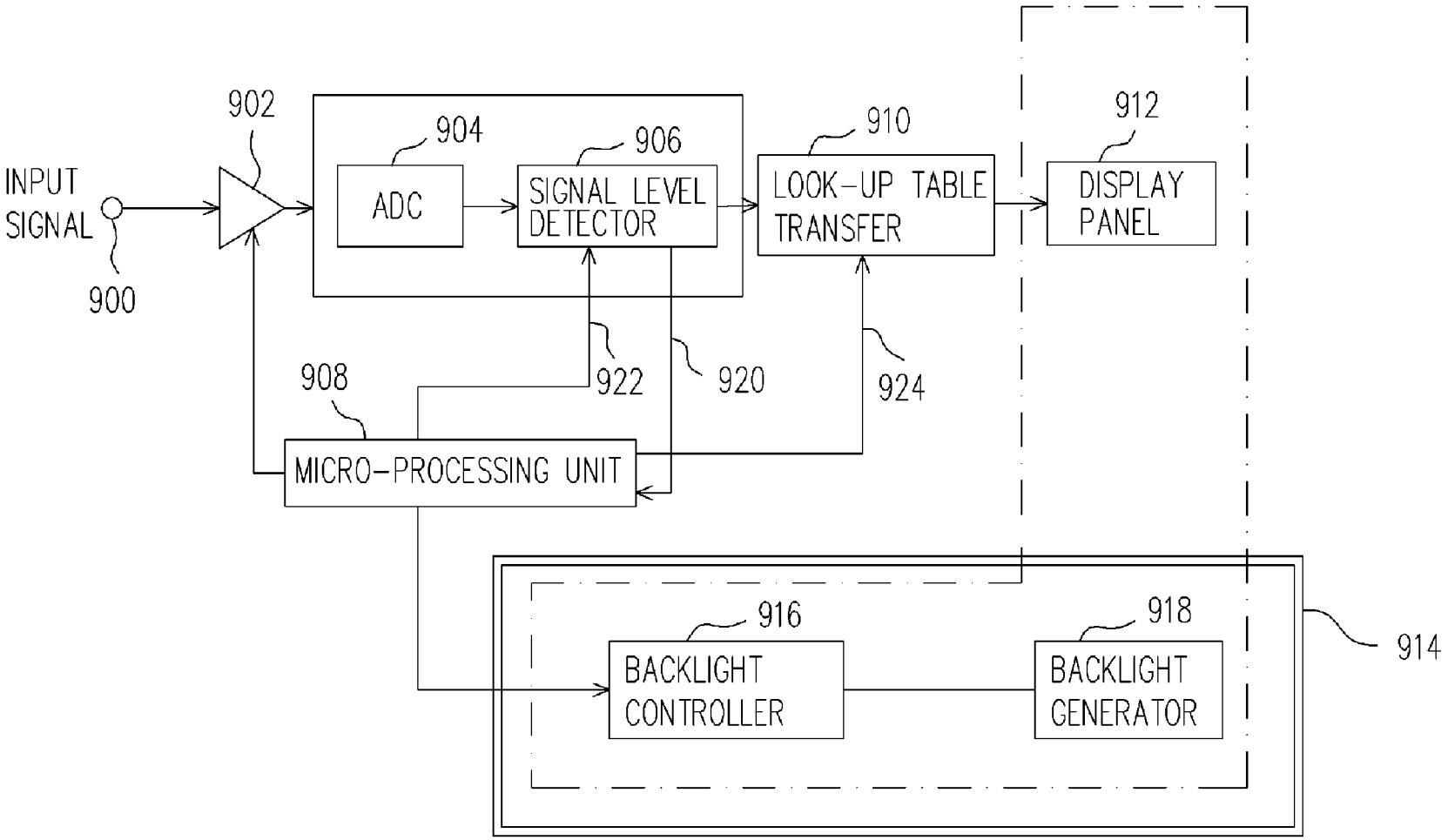
FIG. 9 is a schematic block diagram of a structure for automatic adjusting brightness according to one embodiment of the present invention.

The following will describe the structure for automatic adjusting the brightness by performing the above method. FIG. 9 is a schematic block diagram of a structure for automatic adjusting brightness according to one embodiment of the present invention. In FIG. 9, the structure for automatic adjusting the brightness can be installed in common panel display devices. The preferred panel display device is, for example, LCD, OLED or PDP, and the best is LCD or OLED. After the input signal containing the pixel information is input from a terminal 900, the input signal may be first enlarged by an amplifier 902. Then, the input signal is digitalized using an analog-to-digital converter (ADC) 904. A signal level detector 906 receives the digitalized pixel information to analyze the signal level, wherein the signal level corresponds to the pixel grey level. The sum quantity of the high brightness pixels obtained after analysis is input into a micro-processing unit 908, for example, a microcomputer or a microprocessor, for analysis, so as to obtain the display duty cycle according to the previous condition. The display duty cycle is, for example, sent to a look-up table transfer 910 to control the display duty cycle of the image. Moreover, the pixel information of the actual image is also input to the look-up table transfer 910 from the signal level detector 906 to generate display signal to the display panel 912 for display. In addition, the micro-processing unit 908 can also feed back some information to the signal level detector 906. However, all of these are the variations of design, but not the only options.

In addition, if the display apparatus is not self-illuminating, such as LCD, which requires a backlight module 914. At this time, the micro-processing unit 908 can also send the information of the display duty cycle to the backlight controller 916 of the backlight module 914, and the display duty cycle is adjusted simultaneously so as to control a backlight generator 918 to generate a light source for display.

It needs to be noticed that the structure in FIG. 9 is just a schematic diagram of a display apparatus integrated with the structure for automatic adjusting the brightness, wherein some blocks can also be integrated and achieved using the original configuration of the display apparatus, so that the design structure of the conventional display apparatus needs not to be revised too much.

Figure 10:
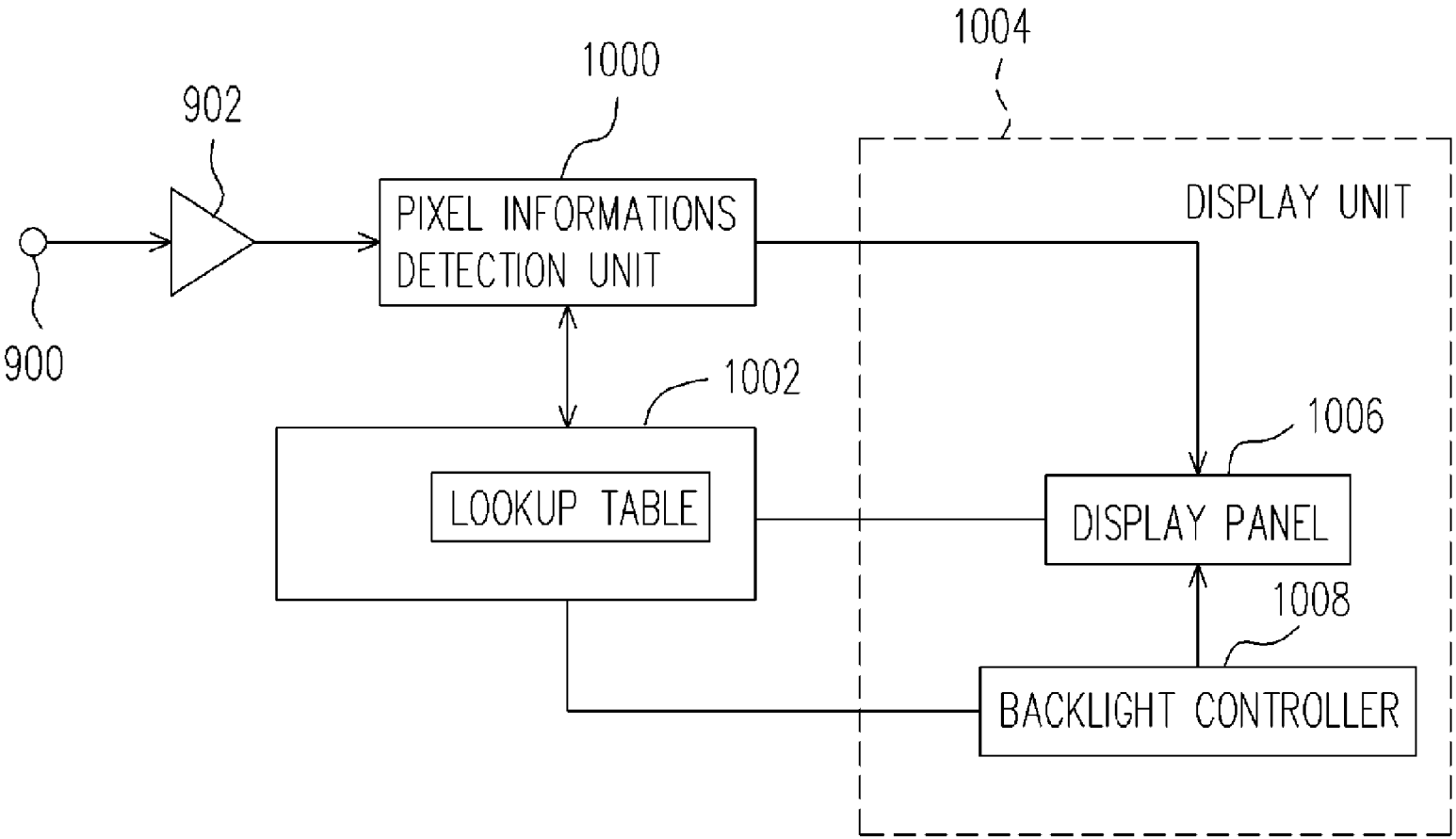
FIG. 10 is a schematic block diagram of a structure for automatic adjusting brightness according to another embodiment of the present invention.

FIG. 10 is a schematic block diagram of a structure for automatic adjusting brightness according to another embodiment of the present invention. For the display apparatus with the structure for automatic adjusting the brightness, the structure for automatic adjusting the brightness may have a pixel information detection unit 1000, which receives the input pixel information and converts it to multiple digitalized pixel information. A processing unit 1002 is coupled with the pixel information detection unit 1000, so as to process the digitalized pixel information. The processing unit 1002 obtains an image load according to the digitalized pixel information of an image, and compares the image load with a first predefined range to output a controlling signal to control the display panel 1006 of the display unit 1004, so as to display using the obtained display duty cycle. If the backlight is also required to be controlled, the backlight controlling unit 1008 can control the intensity of the backlight.

Of course, if a hysteresis effect is required, the mechanism in FIG. 8 can also be included in the analyzing process, obtaining the display duty cycle. For the design of the hardware, it has been acceptable if the above mentioned method and mechanism can be implemented, and it is not limited to some changes and integration.

Using the value of the image load, the present invention proposes to divide the display duty cycle into three areas respectively controlling the brightness of the image using the suitable display duty cycle. Therefore, the brightness can be automatically adjusted according to the image load, so as to obtain better display effect.

Further, the present invention provides the hysteresis effect as shown in FIG. 8, which further improves the display effect, and at least the display effect of the sparking object is improved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for automatic adjusting brightness, suitable for use in a display apparatus to control a display duty cycle, the display duty cycle is a ratio corresponding to a display cycle of a pixel, and the method comprising:

receiving a plurality of pixel information of an image, wherein the image has a total number of pixels;

analyzing the brightness distribution of the pixel information to obtain an image load, wherein the image load is a ratio of the number of the pixel information with a brightness level greater than a relative high gray level to the total number of pixels; and comparing the image load with a first predetermined range and setting the display duty cycle according to the result of comparison.

2. The method for automatic adjusting brightness as claimed in claim 1, wherein a first comparison condition for comparing the image load with the first predefined range comprises:

setting the display duty cycle to be an upper limit if the image load is less than the first predefined range;

setting the display duty cycle to be a lower limit if the image load is greater than the first predefined range; and setting the display duty cycle to be a first operation quantity between the upper limit and the lower limit if the image load is in the first predefined range, according to the current image load.

3. The method for automatic adjusting brightness as claimed in claim 1, wherein the first predefined range is 50%-80% of the overall image load.

4. The method for automatic adjusting brightness as claimed in claim 1, wherein the relative high gray level for determining the image load is a value of 56/256.

5. The method for automatic adjusting brightness as claimed in claim 2, wherein the first operation quantity for setting the display duty cycle between the upper limit and the lower limit is obtained using a linear interpolation.

6. The method for automatic adjusting brightness as claimed in claim 2, further comprises providing a second predefined range to form a second comparison condition, wherein if the display duty cycle being currently set is less than the display duty cycle being previously set contiguously, then the first comparison condition is selected, and if the display duty cycle being currently set is greater than the display duty cycle being previously set contiguously, then the second comparison condition is selected.

7. The method for automatic adjusting brightness as claimed in claim 6, wherein the second comparison condition comprises:

setting the display duty cycle to be an upper limit if the image load is less than the second predefined range;

setting the display duty cycle to be a lower limit if the image load is greater than the second predefined range; and setting the display duty cycle to be a second operation quantity between the upper limit and the lower limit if the image load is in the second predefined range, according to the current image load.

8. The method for automatic adjusting brightness as claimed in claim 7, wherein the second operation quantity for setting the display duty cycle between the upper limit and the lower limit is obtained using a linear interpolation.

9. The method for automatic adjusting brightness as claimed in claim 6, wherein, comparing with the first predefined range, the second predefined range adds with a hysteresis corresponding to the image load so as to form a hysteresis adjusting path.

10. The method for automatic adjusting brightness as claimed in claim 9, wherein the hysteresis is 2%-5% of the overall image load (100%).

11. The method for automatic adjusting brightness as claimed in claim 2, wherein a upper limit and a lower limit of the first comparison condition is 100% and 50%, respectively.

12. A structure for automatic adjusting brightness for receiving a plurality of pixel information to control a display duty cycle of a display apparatus, and the display duty cycle is a ratio corresponding to a display cycle of a pixel, and the structure for automatic adjusting brightness comprising:

a pixel information detecting unit, receiving the pixel information and converting the pixel information to multiple digitalized pixel information; and a processing unit, coupled with the pixel information detecting unit to process the digitalized pixel information, wherein the processing unit obtains an image load according to the digitalized pixel information of an image, wherein the image load is obtained by analyzing the brightness distribution of the digitalized pixel information, in which the image load is a ratio of the number of the digitalized pixel information with a brightness level greater than a relative high gray level to the total number of the digitalized pixel information, and compares the image load with a first predetermined range, so as to output a first control signal to control the display duty cycle of the display apparatus.

13. The structure for automatic adjusting brightness as claimed in claim 12, wherein a first comparison condition for comparing the image load with the first predefined range comprises:

setting the display duty cycle to be an upper limit if the image load is less than the first predefined range;

setting the display duty cycle to be a lower limit if the image load is greater than the first predefined range; and setting the display duty cycle to an operation quantity between the upper limit and the lower limit if the image load is in the first predefined range, according to the current image load.

14. The structure for automatic adjusting brightness as claimed in claim 12, wherein the processing unit further comprises comparing the image load with a second predefined range to output a second control signal, so as to control the display duty cycle of the display device, wherein comparing with a first predefined range, the second predefined range adds with a hysteresis corresponding to the image load so as to form a hysteresis adjusting path.

15. A display apparatus, comprising:

a display unit; and an apparatus for automatic adjusting brightness as claimed in claim 12.

16. The structure for automatic adjusting brightness as claimed in claim 12, wherein the relative high gray level for determining the image load is a value of 56/256.

17. The structure for automatic adjusting brightness as claimed in claim 13, wherein the operation quantity is obtained using a linear interpolation.

18. The structure for automatic adjusting brightness as claimed in claim 14, wherein if the display duty cycle being currently set is less than the display duty cycle being previously set contiguously, the first comparison condition is selected; if the display duty cycle being currently set is greater than the display duty cycle being previously set contiguously, the second comparison condition is selected.

19. The structure for automatic adjusting brightness as claimed in claim 18, wherein the second comparison condition comprises:

setting a display duty cycle to be an upper limit if the image load is less than the second predefined range;

setting the display duty cycle to be a lower limit if the image load is greater than the second predefined range; and setting the display duty cycle to an operation quantity between the upper limit and the lower limit if the image load is in the second predefined range, according to the current image load.

20. The structure for automatic adjusting brightness as claimed in claim 19, wherein the operation quantity is obtained using a linear interpolation.

21. The structure for automatic adjusting brightness as claimed in claim 14, wherein the hysteresis is 2%-5% of the overall image load (100%).

22. The display apparatus as claimed in claim 15, wherein the processing unit further comprises comparing the image load with a second predefined range to output a second control signal, so as to control the display duty cycle of the display apparatus, wherein comparing with the first predefined range, the second predefined range adds with a hysteresis corresponding to the image load so as to form a hysteresis adjusting path.

23. The display apparatus as claimed in claim 22, wherein the hysteresis adjusting path is:

if the display duty cycle being currently set is less than the display duty cycle being previously set contiguously, a first comparison condition is selected for comparison; if the display duty cycle being currently set is greater than the display duty cycle being previously set contiguously, the second comparison condition is selected for comparison, wherein the second comparison condition comprises:

setting a display duty cycle to be an upper limit if the image load is less than the second predefined range;

setting the display duty cycle to be a lower limit if the image load is greater than the second predefined range; and setting the display duty cycle to a second operation quantity between the upper limit and the lower limit if the image load is in the second predefined range, according to the current image load.

* * * * *